United States Patent [19]

Keener

[11] Patent Number: 5,029,864

[45] Date of Patent: Jul. 9, 1991

[54] GOLF CLUB HEAD WITH GROOVED STRIKING FACE

[76] Inventor: Michael B. Keener, 16227 Cairnway, Houston, Tex. 77084

[21] Appl. No.: 535,574

[22] Filed: Jun. 11, 1990

[51] Int. Cl.[5] ..... A63B 53/04

[52] U.S. Cl. ..... 273/175; 273/77 A

[58] Field of Search ..... 273/167 J, 175, 162 R, 273/162 F, 164, 167 R, 167 D, 167 F; D21/220, 214

[56] References Cited

U.S. PATENT DOCUMENTS 3,869,126 3/1975 Thompson ..... 273/167 J

*Primary Examiner*—George J. Marlo

*Attorney, Agent, or Firm*—Gunn, Lee & Miller

[57] ABSTRACT

A planar club face is set forth which has multiple parallel straight line grooves formed in the planar face. While the grooves are V-shaped when viewed at right angles, the V is set at an angle so that it defines within the groove a normal face and a contact face. Both of the groove faces are full length along the groove, and the several grooves span most of the planar club face. The normal face does not contact the ball while the golf ball is contacted by the face. The contact face changes the grip of the club face with the ball at the instant of impact so that improved backspin control is achieved. The contact face has a greater surface area than the normal face.

13 Claims, 1 Drawing Sheet

| CLUB NO. | LOFT | ≤28 |
|---|---|---|
| 3 | 20 | 125 |
| 4 | 25 | 120 |
| 5 | 30 | 115 |
| 6 | 35 | 110 |
| 7 | 40 | 105 |
| 8 | 45 | 100 |
| 9 | 50 | 95 |
| P.W. | 55 | 90 |

GOLF CLUB HEAD WITH GROOVED STRIKING FACE

BACKGROUND OF THE DISCLOSURE

The present disclosure is directed to the grooves formed across the club face of golf clubs, particularly irons and to a modified form of groove. It is known to make V-shaped grooves across club faces where a cutting tool forms a symmetrical V-shaped groove (with an axis of symmetry centered in the groove and normal to the club face). In the groove, there are opposing faces defining the groove or valley and they are inclined at equal and opposite angles with respect to the club face. The present disclosure is directed to a V-shaped groove where the groove faces have different angles. Rather, one of the groove faces is approximately perpendicular to the face of the club and the other defines a gradual angle with respect to the club face so that is is exposed for contact with the ball. For nomenclature, the two faces will be described as the normal face and contact face.

In play, especially with the higher numbered irons, control is obtained in part by means of backspin. At the time of impact, the golf ball is contacted against the club face with substantial deformation. In fact, the deformation is very substantial, almost flattening the golf ball, perhaps in the fashion of a pancake. Control of the ball in flight is partly exercised by backspin, and more control is obtained on the bounce when the ball has the proper backspin.

Grooves are permitted in accordance with the rules of the governing authorities relating to golf clubs. By and large, the most popular and common type of groove and one which is permitted in accordance with the rules is a V-shaped groove having opposing faces at equal and opposite angles. The groove is defined by left and right faces which are cut at equal and opposite angles and which intersect at a valley, therebeing multiple grooves parallel to one another across the club face. The present disclosure is directed to an improvement over and distinctive from the groove on club faces presently in use. It appears to offer a better type of backspin control in contrast with the previously used symmetrical V-shaped groove and other grooves such as those having a square profile, a rectangular profile, or a U-shaped profile. The present disclosure sets out a groove construction for a club face which is formed in multiple parallel, preferably evenly spaced grooves. The same grooves are cut in club faces ranging up to a nine iron, and if desired, they can even be placed on a pitching wedge. In other words, the present disclosure sets out a grooved construction which can be implemented on club faces having an angle which angle exceeds that of a putter. Further, the present disclosure sets out an apparatus which is a modified club face for all angles of club so that a set of clubs having similar swing characteristics can be used. They are all provided with a common weight and length and they are all provided with a common mode of engaging the golf ball, so to speak, gripping the ball momentarily as it is driven with the iron and backspin is initially imparted.

The present disclosure is therefore summarized as a new construction groove for the club faces of irons having an angle greater than a putter extending up to a pitching wedge and including the numbered irons. The groove is cut repetitively, is positioned at even spacing across the facing of the club, and is arranged for taking a better grip on the ball. The individual grooves are identical. The identical grooves are provided with a normal face which is nearly perpendicular and is located at the high side of the groove. A contact face is at the low side of the groove. The contact face defines a non-symmetrical groove so that the normal face is above and the contact face below. Contact with the golf ball is primarily on the club face with the contact face achieving some added contact so that a better grip is taken at the instant of impact.

BRIEF DESCRIPTION OF THE DRAWINGS

So that the manner in which the above recited features, advantages and objects of the present invention are attained and can be understood in detail, more particular description of the invention, briefly summarized above, may be had by reference to the embodiments thereof which are illustrated in the appended drawings.

It is to be noted, however, that the appended drawings illustrate only typical embodiments of this invention and are therefore not to be considered limiting of its scope, for the invention may admit to other equally effective embodiments.

DETAILED DESCRIPTION OF THE PREFERRED EMBODIMENT

Figure 1:
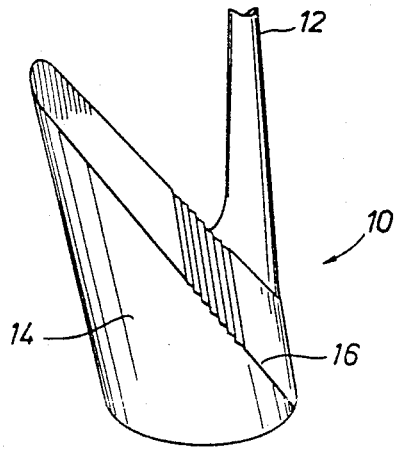
FIG. 1 is a side view of an iron showing a club face which is at some angle determined by the angle of the iron and which can range from a one iron to a pitching wedge.

Attention is now directed to FIG. 1 of the drawings where the numeral 10 identifies a golf club which is constructed in accordance with the teachings of the present disclosure. It is a club head which connects with a club shaft 12 and has a body 14. It incorporates a club face 16 which has an angle to the surface (not shown) so that the club head 10 can be any iron which ranges from just above a putter up to a pitching wedge. This in theory encompasses the one iron at the low end to the nine iron at the top end, and the pitching wedge which has even more angle. The normal club inventory comprises a range of the above mentioned ten clubs although occasionally one will see a pitching wedge with a greater angle. Generally, these are irons which are equipped with a metal face plate insert for providing actual contact against the golf ball. The grooves spoken of hereinafter are formed in the facing area 16 which contacts the ball. If single piece construction is used, these grooves are formed in the single head member. If an insert is involved, it likewise is provided with the grooves which make up the subject of the present disclosure.

Figure 2:
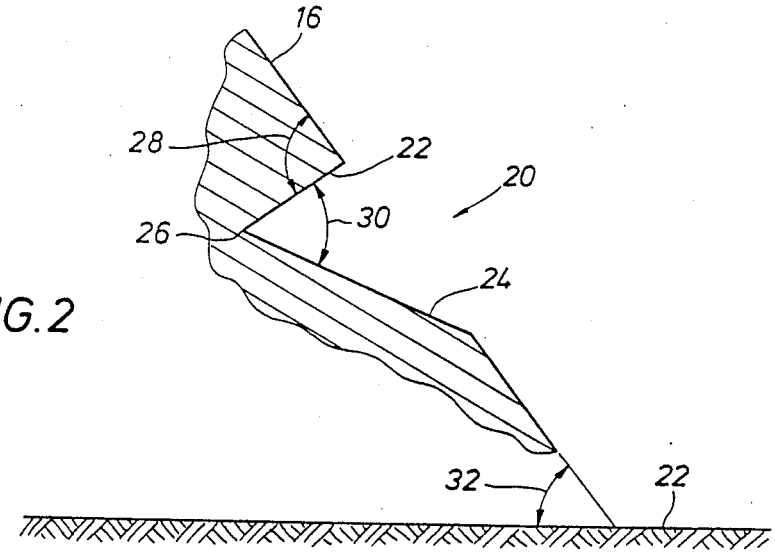
FIG. 2 is an enlarged detailed view in section showing a groove perpendicular to the plane of the view and further illustrating a groove which is defined by a normal face and a contact face.

The present disclosure applies to all irons as mentioned above and preferably to the three iron and those with greater angle. In particular, the number of grooves can vary but a typical number across the entire club face ranges up to about fifteen grooves. The several grooves are included at uniform spacing in the ordinary construction, and the spacing normally is no less than three times groove width and no less than 0.75 inches or 1.9 mm between grooves. The total number of grooves is usually about ten to fifteen. The grooves heretofore are not deep, and the groove of the present disclosure preferably conforms to this depth dimension. That is, grooves heretofore have been up to about 0.5 mm deep, and in the present disclosure they are likewise provided with a depth of about this measure. The depth is at least 0.2 mm at a minimum and preferably ranges up to about 0.5 mm at a maximum. The stated dimension is defined by the USGA (the governing body) and is presently defined as a maximum. This dimension may be changed by the governing body and if such a change is made, the preferred maximum should also change in like measure. A segment of a club face is shown in FIG. 2. Again, the exposed face is illustrated at 16. The groove of the present disclosure is shown in a very enlarged view at 20. Only a single groove has been shown because the remaining grooves have identical construction. The groove 20 is horizontal with respect to the horizontal reference surface identified at 22. The club face 16 has an angle with respect to the surface 22. This angle is dependent on the angle of the club. For purposes of illustration, FIG. 2 will be described as a particular iron. The developed and described construction of the groove 20 is thus formed of or made of the normal face 22 and the contact face 24. They define the bottom 26 of the groove 20. This is the intercept of the two faces. The edges at the club face 16 are deburred so that the edges are crisp or sharp without burrs.

The groove 20 should be considered in greater detail. Generally, the several grooves across the club face have a groove width in the range of about 0.3 mm to about 0.9 mm. The preferred width is about 0.5 mm or greater. The stated dimension is defined by the USGA (the governing body) and is presently defined as a maximum. This dimension may be changed by the governing body and if such a change is made, the preferred maximum should also change in like measure. The normal face 22 is located at a specific angle with respect to the club face 16. It is not, however, required or mandated that the face 22 be precisely normal. Rather, it can encompass a range of angles where the angle 28 is preferably about 90° to about 110° . The supplemental angle derived from this measure is about 70° to about 90° , sufficient to assure that the normal face is substantially out of contact with the golf ball. The normal face extends to the intercept at 26. The intercept is located at the maximum depth of the groove. The maximum depth is limited to 0.5 mm by the USGA, noted above. As will be understood, if the groove is cut deeper and otherwise has the same angles, the width is inevitably increased, thereby increasing the width of the contact face 24. This face in particular imparts enhanced backspin and controlled backspin in use.

Figure 3:
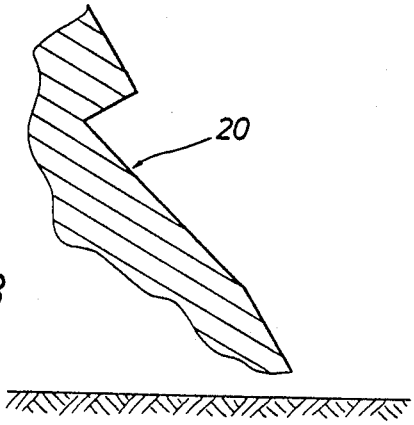
FIGS. 3 and 4 show other club faces with grooves in accordance with the teachings of the present disclosure so that the several views describe views for clubs having different club face angles.
Figure 4:
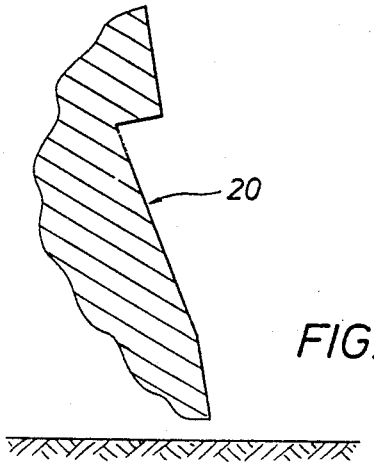

FIGS. 3 and 4 show alternate clubs with the groove 20. The groove remains substantially the same in construction but differs primarily in certain angles. Perhaps a better way to illustrate this is to compile the data for a set of irons. Below is a list of irons organized in tabular form in the first column, an indication of club loft angle in the second column, and the angle 28 is in the third column. Club loft is an angle measured with respect to a vertical reference which is otherwise normal to the surface 22' shown in FIG. 2 of the drawings. Thus, these club measurements are believed to be well established so that a number 5 iron provides an example, and according to the loft angle, that angle is 30° . The face 16 of a five iron is thus tilted at a 30° angle with respect to the vertical, or the club face extends upwardly at an angle of 60° with respect to the horizontal reference. Generally, the table shows that the loft angle and the angle 28 add to provide a sum of 145° for the two angles. The loft angle differs by 5° for each club number; as the left angle is varied, the angle 28 is likewise varied. It will be observed that no entry has been made for a one iron or two iron; these clubs are not commonly used for shots where backspin is an important factor. They have such low loft angles that they are normally involved in play where the backspin is not an important factor. However, for clubs having the loft of a three iron or greater, the factors become more important and to this end, data has been included for all the irons between the three iron and the pitching wedge. The angle at 26 can be incorporated subject to the control of the table set forth above, but in general terms it is near 90° . The range can be between about 75° for a pitching wedge to about 105° for a three iron. Recalling that specification of two of the three angles of a triangle will specify the third angle, the acute angle of intercept between the contact face 24 and the club face 16 is typically quite small, typically in the range of about 30° to 70° .

As mentioned, the total width of the grooves is permitted to be no larger than about 0.9 mm. This provides a repeated grooved construction which is not any deeper than required, and typically up to about 0.5 mm in depth. Preferably, these grooves are formed by using a cutting point such as a rotating head and a milling machine which cuts the profile described as the milling head is progressively moved across the face of the club. One or multiple passes of a cutting tool are thus used to form the grooves. The grooves are normally cut with machining forming the two faces thereof, and with care taken to debur the sharp edges to assure a uniform edge which is free of snags.

The present structure is constructed with or provided with horizontal guidelines which become the groove guide mechanism. By the term horizontal, reference is made to the position of the groove with respect to the surface 22 at or about the instant at which a golf ball is struck. Thus, at the moment of striking, the loft angle comes into play, contacting the ball so that the ball is lifted as a result of the loft angle. On the other hand, the grooves are formed as a means of permanently constructing the club face for the requisite angle of attack so that proper backspin can be imparted. As a generalization, the impact is sufficient that the club deforms the ball which mashed flat against the face of the club and deforms slightly into the grooves 20 whereby gripping is improved. At the time of striking the ball, backspin is imparted so that the ball rotates about an axis that is approximately parallel to and raised above the ground surface 22 shown in FIG. 2. In other words, the backspin is about an axis which is approximately perpendicular to the plane of FIG. 2. The rotative speed is likewise dependent on the bite where the ball is engaged by the club head. This bite is enhanced by the presently disclosed grooves. Indeed, the grooves will drive the ball much farther than though as a result of the extended differential engagement of the golf ball with the club head as taught herein.

As a summary of the clubs, the table below sets out particular angular differences so that one may understand and see the differences and similarities of the grooves especially with different clubs, even the pitching wedge.

| Club Number | Loft Angle | Angle 28 |
|---|---|---|
| 1 | 10 | |
| 2 | 15 | |
| 3 | 20 | 125 |
| 4 | 25 | 120 |
| 5 | 30 | 115 |
| 6 | 35 | 110 |
| 7 | 40 | 105 |
| 8 | 45 | 100 |
| 9 | 50 | 95 |
| P.W. | 55 | 90 |

While the foregoing is directed to the preferred embodiment, the scope thereof is determined by the claims which follow.

What is claimed is:

1. An improved golf club which comprises a head for a golf club having a set of grooves formed therein across a planar face wherein multiple grooves are formed approximately parallel to one another and are deployed across the planar face of the golf club exposed thereabove to substantially groove the planar face of the golf club wherein the grooves are formed by a normal groove face and contact groove face and the normal face is positioned so that it ordinarily does not come into contact with the golf ball when struck with the planar face and wherein the contact face does make contact with the ball on striking the ball to thereby enhance the grip of the club momentarily with the ball.

2. The apparatus of claim 1 wherein multiple duplicate grooves are positioned evenly spaced vertically from bottom to top along the planar club face, and wherein said club head has a loft angle with respect to a perpendicular reference.

3. The apparatus of claim 1 wherein the loft angle is 20° for a three iron and the normal face describes an angle of 125° with respect to the club face.

4. The apparatus of claim 1 wherein the loft angle is 25° for a four iron and the normal face describes an angle of 120° with respect to the club face.

5. The apparatus of claim 1 wherein the loft angle is 30° for a five iron and the normal face describes an angle of 115° with respect to the club face.

6. The apparatus of claim 1 wherein the loft angle is 35° for a six iron and the normal face describes an angle of 110° with respect to the club face.

7. The apparatus of claim 1 wherein the loft angle is 40° for a seven iron and the normal face describes an angle of 105° with respect to the club face.

8. The apparatus of claim 1 wherein the loft angle is 45° for an eight iron and the normal face describes an angle of 100° with respect to the club face.

9. The apparatus of claim 1 wherein the loft angle is 50° for a nine iron and the normal face describes an angle of 95° with respect to the club face.

10. The apparatus of claim 1 wherein the loft angle is 55° for a pitching wedge and the normal face describes an angle of 90° with respect to the club face.

11. The apparatus of claim 1 wherein the groove is defined by the normal face and contact face, and said groove has a depth up to about 0.5 mm.

12. The apparatus of claim 1 wherein the groove is defined by the normal face and contact face, and said groove has a width up to about 0.9 mm.

13. The apparatus of claim 1 wherein multiple parallel straight grooves are formed in the club face and number from ten to about fifteen grooves.

* * * * *